US009896821B1

(12) United States Patent
Rutledge

(10) Patent No.: US 9,896,821 B1
(45) Date of Patent: Feb. 20, 2018

(54) BUCKET ATTACHMENT FOR AN EXCAVATOR

(71) Applicant: Douglas G. Rutledge, Stirling (CA)

(72) Inventor: Douglas G. Rutledge, Stirling (CA)

( * ) Notice: Subject to any disclaimer, the term of this patent is extended or adjusted under 35 U.S.C. 154(b) by 148 days.

(21) Appl. No.: 14/794,345

(22) Filed: Jul. 8, 2015

(51) Int. Cl.
*E02F 3/96* (2006.01)
*E02F 3/407* (2006.01)

(52) U.S. Cl.
CPC ..... *E02F 3/962* (2013.01); *E02F 3/407* (2013.01)

(58) Field of Classification Search
CPC ..... E02F 3/28; E02F 3/34; E02F 3/407; E02F 3/962
See application file for complete search history.

(56) References Cited

U.S. PATENT DOCUMENTS 2,934,183 A * 4/1960 Shaklee ..... E02F 3/3627 403/316
3,187,912 A * 6/1965 McKnight ..... E02F 3/34 414/703
3,760,883 A 9/1973 Birk
4,358,241 A * 11/1982 Anderson ..... E02F 3/7631 414/703
4,545,720 A * 10/1985 Cochran ..... E02F 3/3627 172/275
4,687,407 A * 8/1987 Osborne ..... E02F 3/627 172/473
4,725,189 A * 2/1988 Langenfeld ..... E02F 3/627 414/703
4,890,400 A * 1/1990 Long ..... E01H 5/06 172/815
5,064,338 A * 11/1991 Lawrence ..... A01B 59/06 180/53.7
5,078,569 A * 1/1992 Cook ..... E02F 3/3636 414/685
5,098,252 A * 3/1992 Sheesley ..... E02F 3/3627 172/273
6,094,847 A * 8/2000 Gallenberg ..... A01D 17/10 171/118
7,089,692 B2 * 8/2006 Strait ..... E01H 5/063 172/261
7,491,027 B1 * 2/2009 McFarland ..... E02F 3/3604 37/468
7,617,882 B1 * 11/2009 Street ..... E02F 3/3604 172/817
7,805,862 B2 * 10/2010 Osgood ..... E01H 5/066 172/272
7,805,866 B1 * 10/2010 Osgood ..... E01H 5/066 172/784
8,763,226 B1 * 7/2014 Gustafson ..... E02F 3/3604 29/281.1

(Continued)

*Primary Examiner* — Robert E Pezzuto
*Assistant Examiner* — Jessica H Lutz

(57) ABSTRACT

A bucket attachment for an excavator including a single bucket having a base, a right side wall, a left side wall, a right guide wing, a left guide wing, and a rear wall. A rotatable crossbar is continuously disposed from a first aperture disposed in the right guide wing to a second aperture disposed in the left guide wing. A pair of inverted V-shaped mounting cleats is disposed on an exterior surface of the rear wall adjacent a top edge. A pivotable frame is attached to the crossbar, and a return spring is disposed around the crossbar and attached to the frame.

2 Claims, 4 Drawing Sheets

(56) References Cited

U.S. PATENT DOCUMENTS

| | | | | |
|---|---|---|---|---|
| 2008/0101899 | A1* | 5/2008 | Slonecker | B60D 1/00 414/462 |
| 2011/0277357 | A1* | 11/2011 | Schmeichel | E01H 5/062 37/231 |
| 2012/0138321 | A1* | 6/2012 | Harris | A01B 59/064 172/810 |

* cited by examiner

BUCKET ATTACHMENT FOR AN EXCAVATOR

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of excavator attachments are known in the prior art. However, what has been needed is a bucket attachment for an excavator including a single bucket having a base, a right side wall, a left side wall, a right guide wing, a left guide wing, and a rear wall. What has been further needed is a rotatable crossbar continuously disposed from a first aperture disposed in the right guide wing to a second aperture disposed in the left guide wing. Lastly, what has been needed is a pair of inverted V-shaped mounting cleats disposed on an exterior surface of the rear wall adjacent a top edge and a pivotable frame attached to the crossbar. The pair of mounting cleats and the frame are configured to releasably attach to an excavator blade of an excavator. The pair of mounting cleats allows the bucket attachment to maintain a stable horizontal position while being lifted and moved by an excavator. The pivotable frame on the bottom of the attachment allows for an upward motion of the blade to easily unload the content within the bucket. The bucket attachment for an excavator thus eliminates the need for a loader tractor on a construction site, since an excavator can now be used for moving and distributing dirt, gravel, and other materials.

FIELD OF THE INVENTION

The present invention relates to excavator attachments, and more particularly, to a bucket attachment for an excavator.

SUMMARY OF THE INVENTION

The general purpose of the present bucket attachment for an excavator, described subsequently in greater detail, is to provide an excavator attachment which has many novel features that result in a bucket attachment for an excavator which is not anticipated, rendered obvious, suggested, or even implied by prior art, either alone or in combination thereof.

To accomplish this, the present bucket attachment for an excavator includes a single bucket having a base, a right side wall, a left side wall, a right guide wing, a left guide wing, and a rear wall. The rear wall has an exterior surface, a top edge, a right edge, and a left edge. The right edge is disposed between the right side wall and the right guide wing, and the left edge is disposed between the left side wall and the left guide wing. Each of the right guide wing and the left guide wing has a bottom rear corner.

A rotatable crossbar is continuously disposed from a first aperture disposed in the right guide wing proximal the bottom rear corner to a second aperture disposed in the left guide wing proximal the bottom rear corner. One of a pair of bushings is attached to each of a right surface of the crossbar and a left surface of the crossbar.

The present bucket attachment for an excavator also includes a pair of inverted V-shaped mounting cleats and a pivotable frame attached to the crossbar. The pair of mounting cleats includes a right mounting cleat and a left mounting cleat. Each of the right mounting cleat and the left mounting cleat has a first edge and a second edge. The first edge of each of the right mounting cleat and the left mounting cleat is disposed on the exterior surface of the rear wall adjacent to the top edge and proximal the right edge and the left edge, respectively. The pair of mounting cleats is configured to releasably attach to an excavator blade of an excavator. The pivotable frame is attached to the crossbar and is configured to releasably attach to the excavator blade of the excavator. A return spring is disposed around the crossbar and attached to the frame. The return spring is configured to maintain a positioning of the frame.

The frame optionally includes a pair of elongated downwardly disposed hooks, a pair of L-shaped brackets, a pair of supports, and a plurality of crossbeams. The pair of hooks includes a right hook and a left hook. Each of the right hook and the left hook has a front edge, a rear edge, an upper surface, and a lower surface. The upper surface of the right hook proximal the rear edge is attached to the crossbar proximal the right surface, and the upper surface of the left hook proximal the rear edge is attached to the crossbar proximal the left surface. The pair of L-shaped brackets includes a right bracket and a left bracket. Each of the right bracket and the left bracket is attached to the rear edge of each of the right hook and the left hook, respectively. The pair of supports includes a front support and a rear support. Each of the front support and the rear support is continuously disposed from the upper surface of the right hook to the upper surface of the left hook. Both the front support and the rear support are perpendicularly disposed with the pair of hooks. Each of the plurality of crossbeams is continuously disposed from the rear support to the front support, and each of the plurality of crossbeams is perpendicularly disposed with the front support. The plurality of crossbeams is optionally three.

Thus has been broadly outlined the more important features of the present bucket attachment for an excavator so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
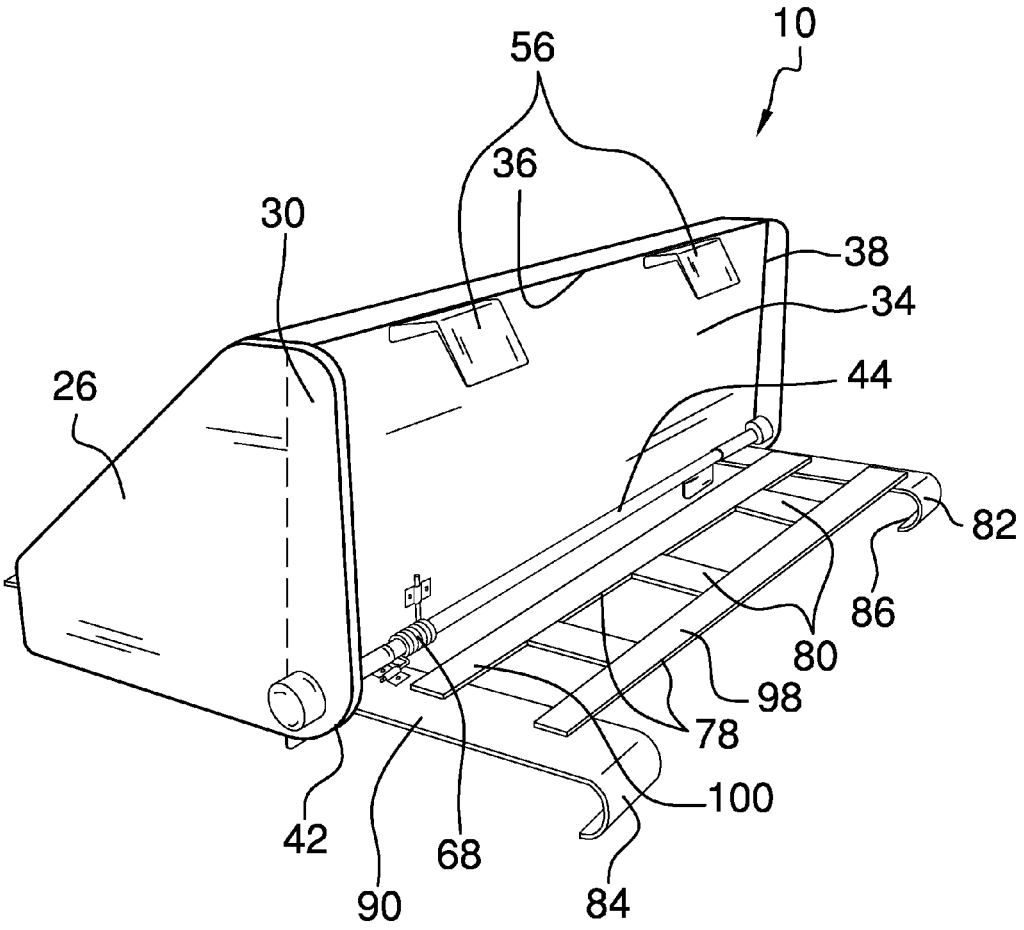
FIG. 1 is a front isometric view showing a pair of hooks, a pair of supports, and a plurality of crossbeams.
Figure 2:
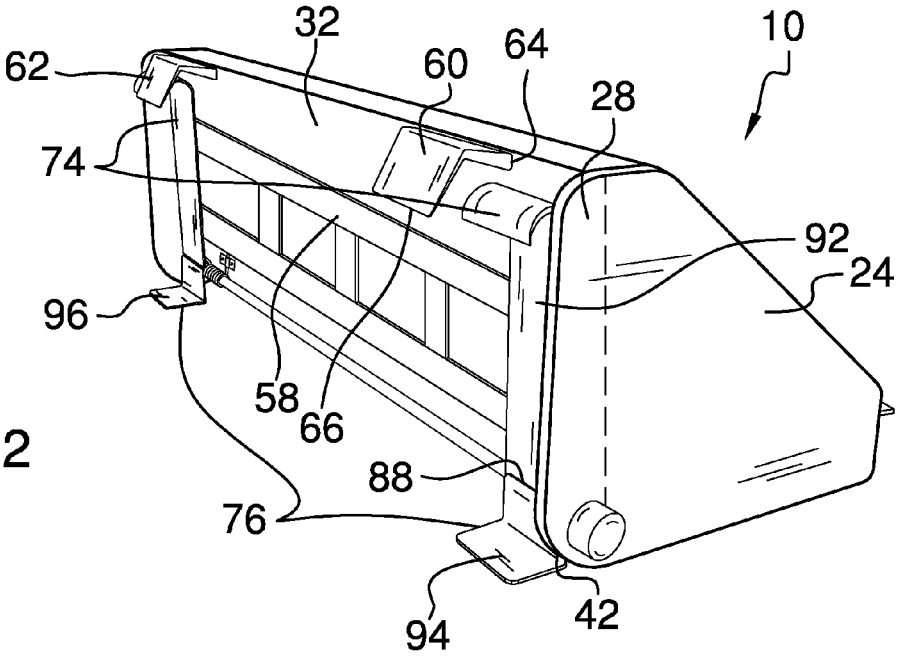
FIG. 2 is a front isometric view showing a pair of brackets.
Figure 3:
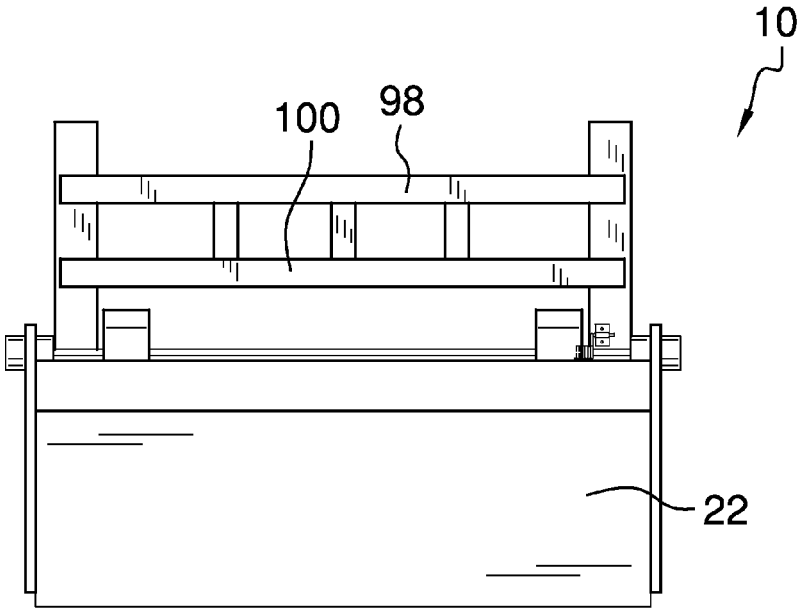
FIG. 3 is a top plan view.

With reference now to the drawings, and in particular FIGS. 1 through 6 thereof, an example of the instant bucket attachment for an excavator employing the principles and concepts of the present bucket attachment for an excavator and generally designated by the reference number 10 will be described.

Referring to FIGS. 1 through 6 the present bucket attachment for an excavator 10 is illustrated. The bucket attachment for an excavator 10 includes a single bucket 20 having a base 22, a right side wall 24, a left side wall 26, a right guide wing 28, a left guide wing 30, and a rear wall 32. The rear wall 32 has an exterior surface 34, a top edge 36, a right edge 38, and a left edge 40. The right edge 38 is disposed between the right side wall 24 and the right guide wing 28, and the left edge 40 is disposed between the left side wall 26 and the left guide wing 30. Each of the right guide wing 28 and the left guide wing 30 has a bottom rear corner 42.

A rotatable crossbar 44 is continuously disposed from a first aperture 46 disposed in the right guide wing 28 proximal the bottom rear corner 42 to a second aperture 48 disposed in the left guide wing 30 proximal the bottom rear corner 42. One of a pair of bushings 50 is attached to each of a right surface 52 of the crossbar 44 and a left surface 54 of the crossbar 44.

Figure 4:
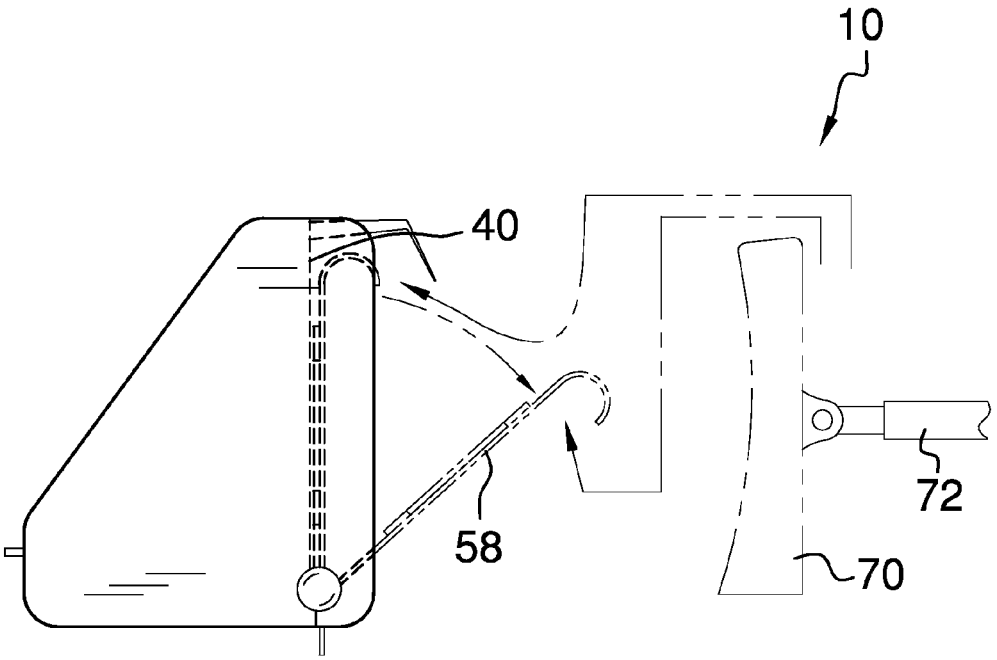
FIG. 4 is a side elevation view.
Figure 5:
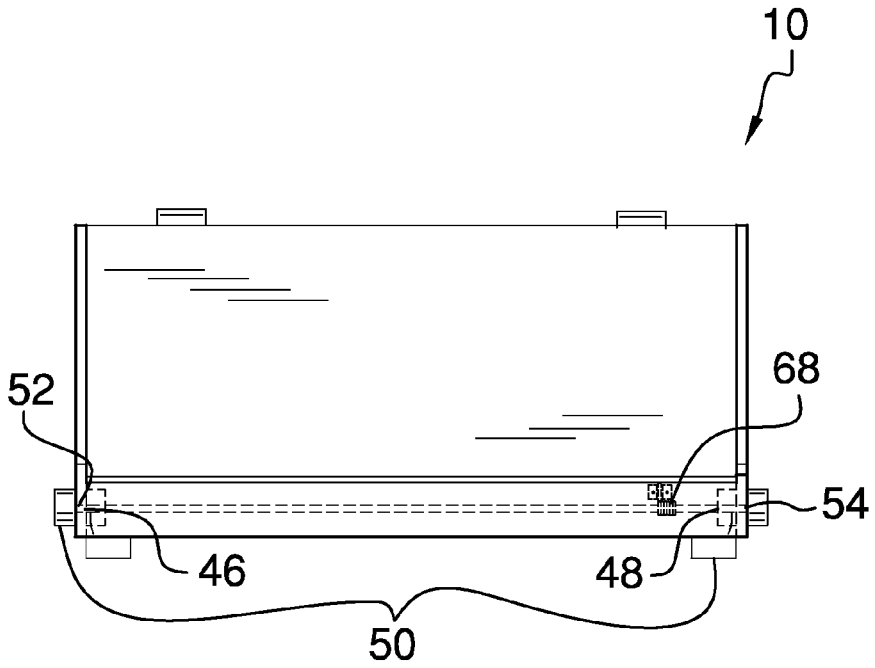
FIG. 5 is a rear elevation view.
Figure 6:
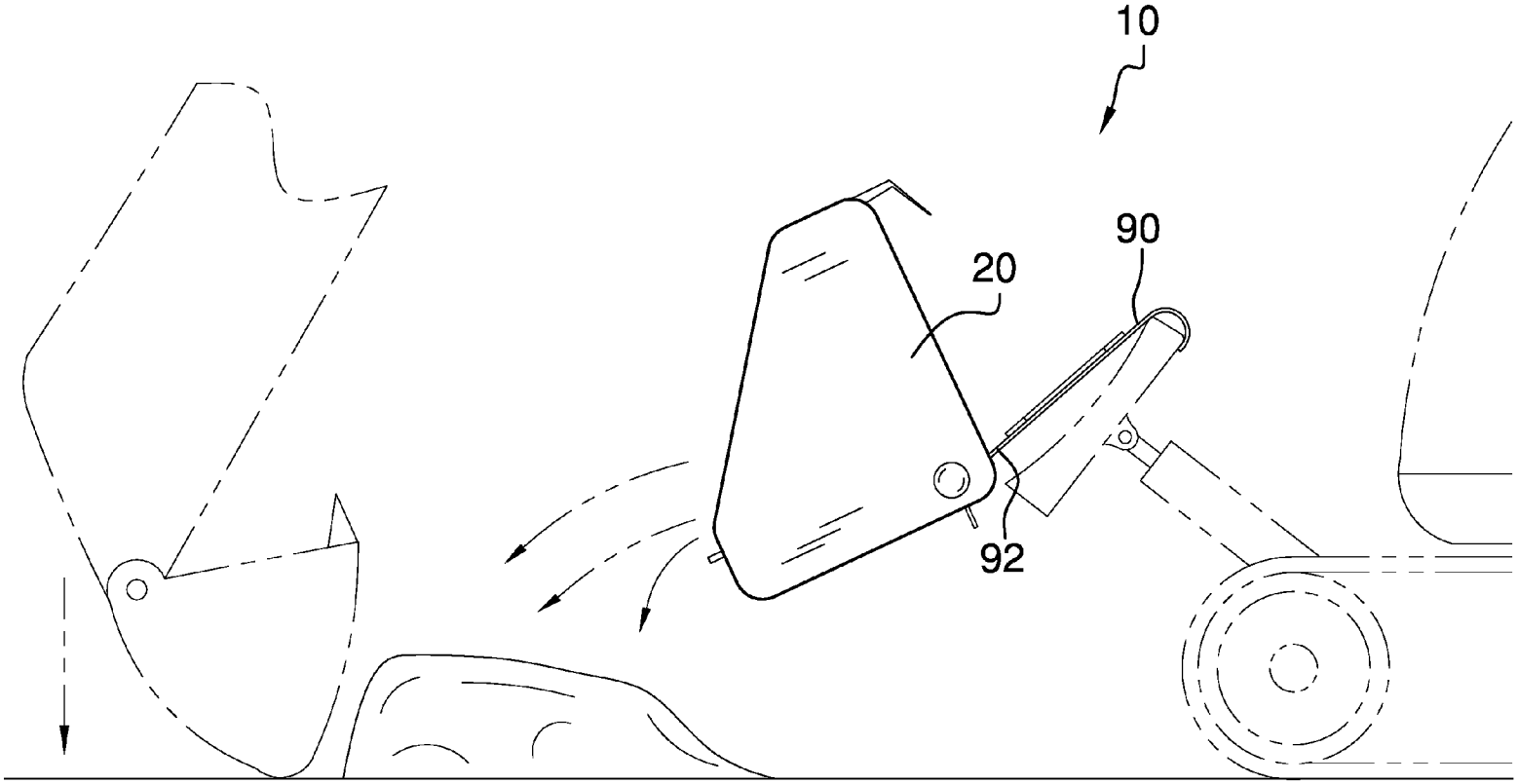
FIG. 6 is an in-use view.

The present bucket attachment for an excavator 10 also includes a pair of inverted V-shaped mounting cleats 56 and a pivotable frame 58 attached to the crossbar 44. The pair of mounting cleats 56 includes a right mounting cleat 60 and a left mounting cleat 62. Each of the right mounting cleat 60 and the left mounting cleat 62 has a first edge 64 and a second edge 66. The first edge 64 of each of the right mounting cleat 60 and the left mounting cleat 62 is disposed on the exterior surface 34 of the rear wall 32 adjacent to the top edge 36 and proximal the right edge 38 and the left edge 40, respectively. The pivotable frame 58 is attached to the crossbar 44. A return spring 68 is disposed around the crossbar 44 and attached to the frame 58. As best shown in FIG. 4, the pair of mounting cleats 56 and the frame 58 are configured to releasably attach to an excavator blade 70 of an excavator 72.

The frame 58 optionally includes a pair of elongated downwardly disposed hooks 74, a pair of L-shaped brackets 76, a pair of supports 78, and a plurality of crossbeams 80. The pair of hooks 74 includes a right hook 82 and a left hook 84. Each of the right hook 82 and the left hook 84 has a front edge 86, a rear edge 88, an upper surface 90, and a lower surface 92. The upper surface 90 of the right hook 82 proximal the rear edge 88 is attached to the crossbar 44 proximal the right surface 52, and the upper surface 90 of the left hook 84 proximal the rear edge 88 is attached to the crossbar 44 proximal the left surface 54. The pair of L-shaped brackets 76 includes a right bracket 94 and a left bracket 96. Each of the right bracket 94 and the left bracket 96 is attached to the rear edge 88 of each of the right hook 82 and the left hook 84, respectively. The pair of supports 78 includes a front support 98 and a rear support 100. Each of the front support 98 and the rear support 100 is continuously disposed from the upper surface 90 of the right hook 82 to the upper surface 90 of the left hook 84. Both the front support 98 and the rear support 100 are perpendicularly disposed with the pair of hooks 74. Each of the plurality of crossbeams 80 is continuously disposed from the rear support 100 to the front support 98, and each of the plurality of crossbeams 80 is perpendicularly disposed with the front support 98. The plurality of crossbeams 80 is optionally three.

What is claimed is:

1. A bucket attachment for an excavator comprising:

a single bucket having a base, a right side wall, a left side wall, a right guide wing, a left guide wing, and a rear wall having an exterior surface, a top edge, a right edge disposed between the right side wall and the right guide wing and a left edge disposed between the left side wall and the left guide wing, each of the right guide wing and the left guide wing having a bottom rear corner;

a rotatable crossbar continuously disposed from a first aperture disposed in the right guide wing proximal the bottom rear corner to a second aperture disposed in the left guide wing proximal the bottom rear corner, wherein one of a pair of bushings is attached to each of a right surface of the crossbar and a left surface of the crossbar;

a pair of inverted V-shaped mounting cleats comprising a right mounting cleat and a left mounting cleat, each of the right mounting cleat and the left mounting cleat having a first edge and a second edge, wherein the first edge of each of the right mounting cleat and the left mounting cleat is disposed on the exterior surface of the rear wall adjacent to the top edge and proximal the right edge and the left edge, respectively;

wherein the pair of mounting cleats is configured to releasably attach to an excavator blade of an excavator;

a pivotable frame attached to the crossbar, wherein the frame is configured to releasably attach to the excavator blade of the excavator;

a return spring disposed around the crossbar and attached to the frame, wherein the return spring is configured to maintain a positioning of the frame;

a pair of elongated downwardly disposed hooks comprising a right hook and a left hook, each of the right hook and the left hook having a front edge, a rear edge, an upper surface, and a lower surface, wherein the upper surface of the right hook proximal the rear edge is attached to the crossbar proximal the right surface, and the upper surface of the left hook proximal the rear edge is attached to the crossbar proximal the left surface;

a pair of L-shaped brackets comprising a right bracket and a left bracket, wherein each of the right bracket and the left bracket is attached to the rear edge of each of the right hook and the left hook, respectively;

a pair of supports comprising a front support and a rear support, wherein each of the front support and the rear support is continuously disposed from the upper surface of the right hook to the upper surface of the left hook;

wherein the front support and the pair of hooks are perpendicularly disposed;

wherein the rear support and the pair of hooks are perpendicularly disposed; and a plurality of crossbeams, each of the plurality of crossbeams continuously disposed from the rear support to the front support, wherein each of the plurality of crossbeams and the front support are perpendicularly disposed.

2. The bucket attachment for an excavator of claim 1 wherein the plurality of crossbeams is three.

* * * * *